US007556542B2

(12) United States Patent
Lischeck et al.

(10) Patent No.: US 7,556,542 B2
(45) Date of Patent: Jul. 7, 2009

(54) ELECTRICAL CONNECTOR IN THE FORM OF A SOCKET CONTACT HAVING A SPECIAL LAMELLAR CONSTRUCTION

(75) Inventors: Andre Lischeck, Vaihingen (DE); Rolf Wittmann, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/674,578

(22) Filed: Sep. 29, 2003

(65) Prior Publication Data

US 2004/0127107 A1 Jul. 1, 2004

(30) Foreign Application Priority Data

Oct. 19, 2002 (DE) ..... 102 48 809

(51) Int. Cl.
*H01R 13/00* (2006.01)

(52) U.S. Cl. ..... 439/851; 439/845

(58) Field of Classification Search ..... 439/851, 439/852, 843, 845, 854–857
See application file for complete search history.

(56) References Cited

U.S. PATENT DOCUMENTS

| | | | | | |
|---|---|---|---|---|---|
| 3,286,222 | A | * | 11/1966 | Drinkwater | 439/843 |
| 4,168,878 | A | * | 9/1979 | Risser et al. | 439/200 |
| 4,934,965 | A | * | 6/1990 | Buddrus et al. | 439/845 |
| 5,135,417 | A | * | 8/1992 | Stanevich | 439/851 |
| 5,599,212 | A | * | 2/1997 | Sawada | 439/843 |
| 5,685,746 | A | | 11/1997 | Maejima | |
| 5,868,590 | A | | 2/1999 | Dobbelaere | |
| 5,951,338 | A | * | 9/1999 | Seko et al. | 439/843 |
| 5,989,078 | A | * | 11/1999 | Chaillot et al. | 439/851 |
| 6,039,614 | A | * | 3/2000 | Ramari | 439/843 |
| 6,068,526 | A | | 5/2000 | Nottrott et al. | |
| 6,102,752 | A | * | 8/2000 | Bommel et al. | 439/845 |
| 6,186,840 | B1 | * | 2/2001 | Geltsch et al. | 439/843 |
| 6,250,974 | B1 | * | 6/2001 | Kerek | 439/843 |

FOREIGN PATENT DOCUMENTS

| | | |
|---|---|---|
| DE | 199 35 793 | 2/2000 |
| EP | 0 833 409 | 4/1998 |
| EP | 1 085 609 | 3/2001 |
| JP | 1040995 | 2/1989 |
| JP | 8007963 | 1/1996 |
| JP | 8045606 | 2/1996 |

* cited by examiner

*Primary Examiner*—Hien Vu
(74) *Attorney, Agent, or Firm*—Kenyon & Kenyon LLP

(57) ABSTRACT

An electrical connector in the form of a vibrationally stressed socket contact for producing an electrical plug connection, in particular in the automotive field. These electrical connectors are made up of an inner contact part and an external retention spring. The inner part itself includes contact lamellae, which rest against a mating component, preferably a knife blade, at a contact point. In order to ensure that the contact reliability is increased by optimum, normal contact force in each contact lamella, even in the case of tilting or vibrating or wobbling mating components (knife blades), the contact part 6 has at least three contact lamellae pointing away from a center segment, each of the contact lamellae having at least one contact point for producing an electrical plug connection to a knife blade. In the state of a produced, electrical plug connection, the free ends of the contact lamellae rest on support elements, which are designed to be a part of the external retention spring.

7 Claims, 3 Drawing Sheets

ELECTRICAL CONNECTOR IN THE FORM OF A SOCKET CONTACT HAVING A SPECIAL LAMELLAR CONSTRUCTION

FIELD OF THE INVENTION

The present invention relates to an electrical connector in the form of a socket contact, including an inner contact part and a spring element, which may be placed over the inner contact part, the inner contact part being made up of an attachment part for receiving a bare end of an electrical line, a center segment, and a contact segment having a contact part.

BACKGROUND INFORMATION

Many connectors of the above-mentioned species are known. As a rule, these connectors are made up of two components, namely an inner contact part and a spring element, the spring element taking the form of a so-called external retention spring, which at least partially surrounds the inner contact part. In order to produce an electrical plug connection, the electrical connector is slipped onto a so-called knife blade, the inner contact part coming into contact with the knife blade. The inner contact part itself is divided up into several regions, namely an attachment part, onto which a bare end of an electrical connector is preferably crimped. In addition, the inner contact part has a center segment, which is preferably formed in the shape of a throat, and on whose throat an attachment element is provided that is designed to fix the inner contact part in position. The inner contact part also has a contact segment possessing a contact part that produces an electrical contact with the diametrically opposed knife blade.

As a rule, the contact parts take the form of contact lamellae. An inner contact part has two or more opposite lamellae, which are situated at a distance from each other, which is less than the thickness of the knife blade. The contact lamellae are forced to spring up by inserting the knife blade. This results in a corresponding deformation, which produces a specific normal force on the contact lamellae and the inserted knife blade at the contact point.

Different specific embodiments of the form of the contact lamellae are also known. First of all, it is provided that contact lamellae be exposed (project outward), so that they may freely spring off of a knife blade in response to being slipped onto it. Another specific embodiment shows a clip that embraces the contact lamellae, the clip resting on the external retention spring. Also known is an exemplary embodiment, in which the contact lamellae are welded to the external retention spring.

When electrical connectors are designed in such a manner that the contact lamellae freely extend inside the external retention spring, the disadvantage is that the so-called normal contact force changes due to, in particular, the relaxation of the contact lamellae material. As a result, an electrical plug connection produced as such is cut off by this relaxation process and may cause, therefore, a corresponding fault.

The further designs of contact lamellae have the disadvantage that the respective, normal contact forces are generated as a function of the remaining contact lamellae. In particular, one of two contact points has a normal contact force that is too high, and one has a normal contact force that is correspondingly low, when the knife blade is tilted, and when vibrational and wobbling motions occur. When the normal contact force is too low, this can lead, in the extreme case, to the disengagement and breakdown of the contact point and, therefore, to the termination of the electrical plug connection. A contact force that is too high can also result in permanent damage to the contact surface (of the knife blade and the contact lamellae), which can lead, in turn, to the failure of the contact point and the electrical plug connection over the service life.

The present construction of electrical connectors of the type mentioned above is designed with a view to attaining a specific force at the contact point during the insertion of the knife blade, without the insertion force causing a certain maximum value to be exceeded during the insertion procedure. The possibilities for designing the shape of the insertion force curve are very limited.

SUMMARY OF THE INVENTION

An object of the present invention is to eliminate the disadvantages of the related art. In particular, it is necessary to increase the contact reliability by ensuring that the normal contact force of each contact lamella is even optimal in the case of tilted knife blades and vibrating, wobbling movement of the knife blade.

An essence of the present invention is for an electrical connector of the type mentioned above to have two or more contact lamellae, which are situated on the contact part and may freely move, however, on their free end (open up) without any further fastening, and whose opening range is limited by limiting elements. The limiting elements preferably correspond to the box-shaped, external retention spring, which embraces the contact lamellae.

An increased contact reliability may be provided by the solution, in which at least two contact lamellae pointing away from the center segment are provided at the contact part, each of the contact lamellae having at least one contact point for producing an electrical connection to a knife blade, and these additionally opening up as a function of the dimensions of the knife blade to be inserted.

The contact lamellae are independent of each other in the direction of their extension (away from the center section). This means that, in contrast to the related art, there is no mutual connection. The free ends of the contact lamellae are only limited in their movement by limiting elements, preferably the external retention spring surrounding the contact lamellae to this effect. In this manner, it is possible for the contact lamellae to expand in an undistorted manner in response to the knife blade being inserted, and for each contact lamella to form a reliable contact point.

DETAILED DESCRIPTION

Figure 1:
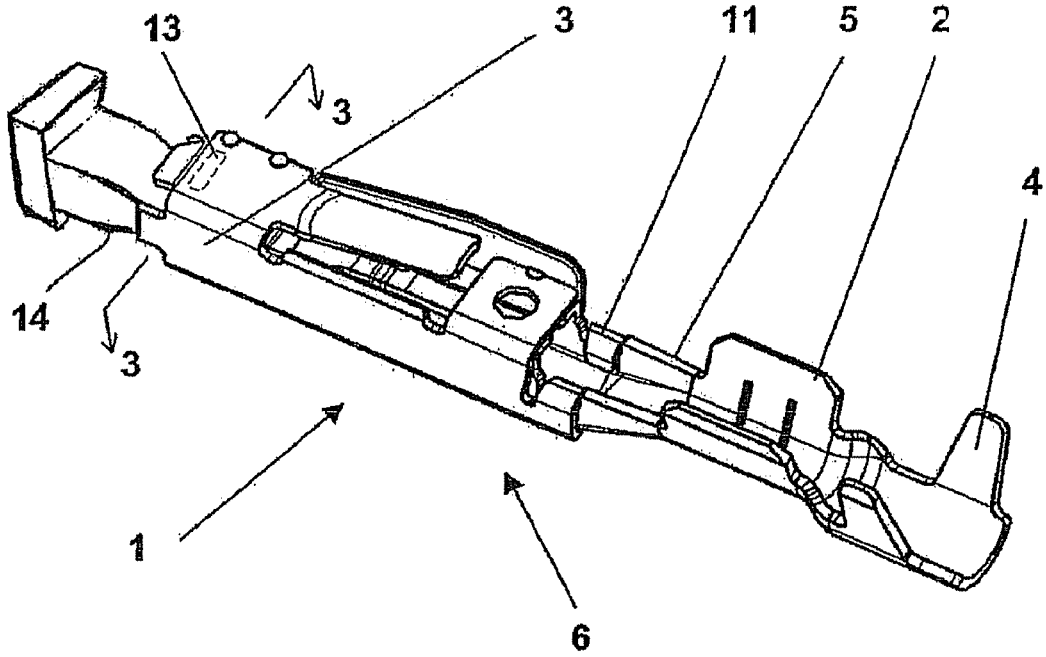
FIG. 1 shows a perspective view of the electrical connector according to the present invention, including an inner contact part and an external retention spring.

Shown in FIG. 1 is an electrical connector 1, which is essentially made up of two components, namely a contact part 2 and an external retention spring 3, external retention spring 3 surrounding at least a portion of contact part 2.

Contact part 2 is preferably divided up into two regions, namely a first region in the form of an attachment part 4, a center segment 5, and a contact segment 6. External retention spring 3 preferably extends in the region of contact segment 6, as well.

Figure 2:
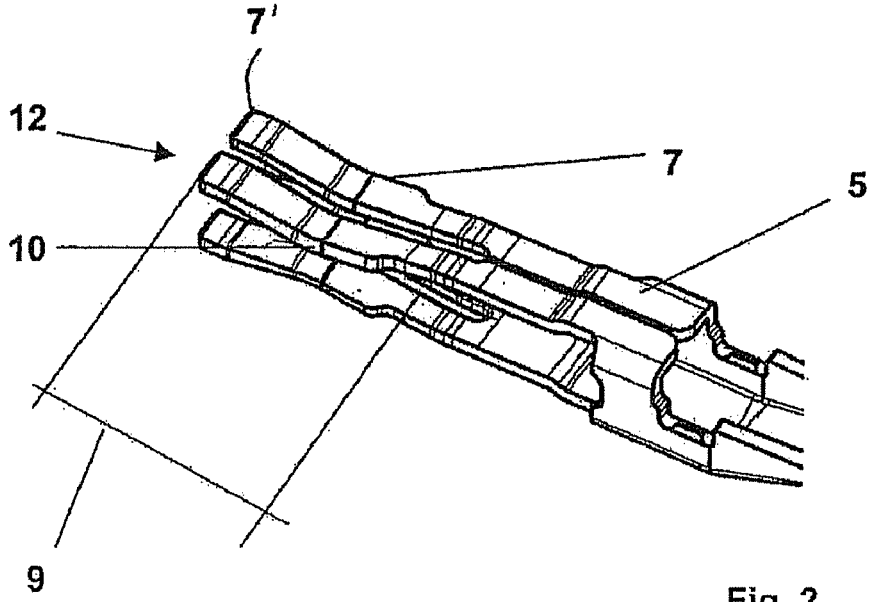
FIG. 2 shows a perspective view of a portion of the inner contact part according to FIG. 1, but, in contrast to FIG. 1, without the external retention spring.

According to the present invention, contact segment 6 has three or more contact lamellae 7. In the exemplary embodiment represented in FIGS. 1 and 2, four contact lamellae are provided, which freely extend away from center segment 5, and a free space 8 is provided between each of the individual contact lamellae 7. Contact lamellae 7 have free ends 7' and a contact region 9, which is used to produce an electrical connection with a knife blade 14, a schematic representation of which is shown inserted into the contact region 9 Contact region 9 of contact lamellae 7 in question is designed in such a manner, that a contact point 10 is formed between the knife blade not shown here and specific contact lamella 7.

Figure 3:
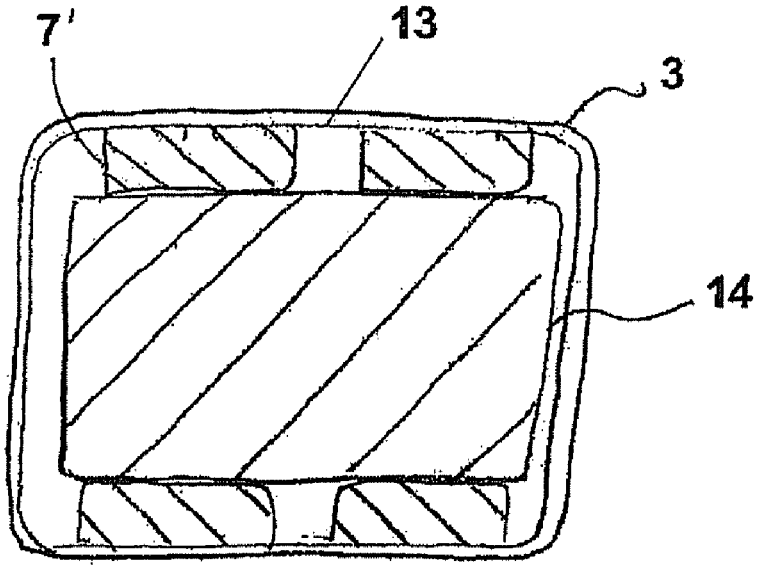
FIG. 3 is a cross-sectional view of the electrical connector taken along line 3-3 in FIG. 1.
Figure 4:
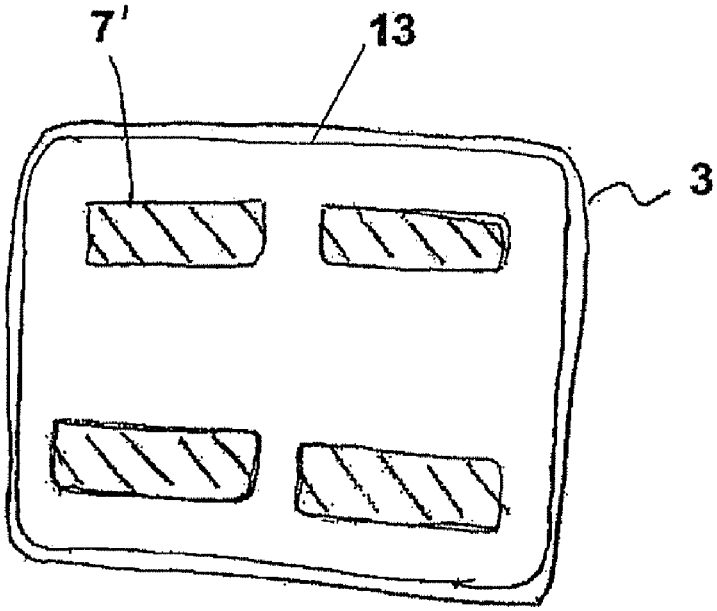
FIG. 4 is a cross-sectional view of the electrical connector taken along line 3-3 in FIG. 1 before insertion of a knife blade.
Figure 5:
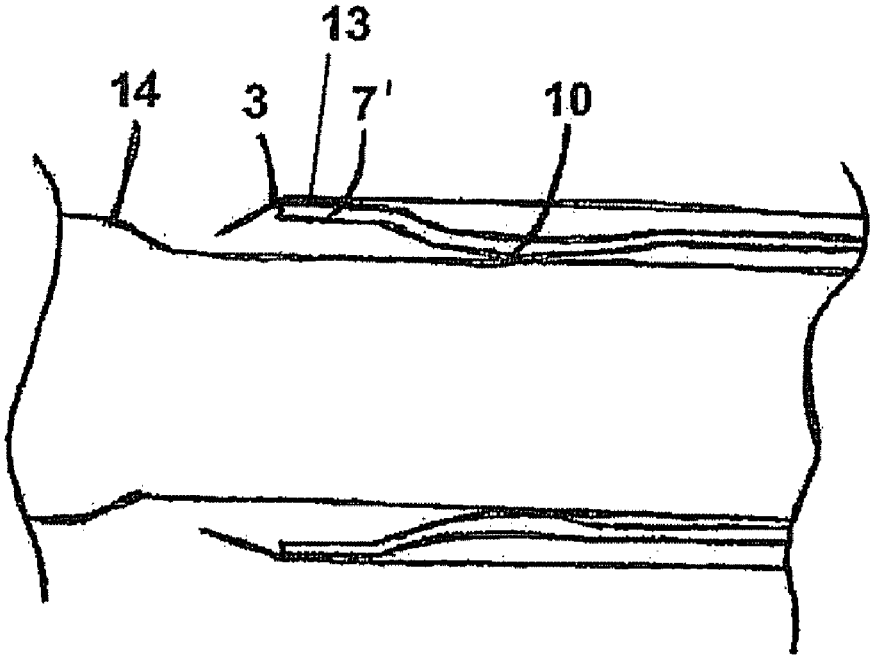
FIG. 5 is a schematic side view representation of a portion of the retention spring and contact lamellae expanded by the knife spring.

FIG. 3 is a cross-sectional view of the electrical connector 1 taken along line 3-3 in FIG. 1. As can be seen in FIG. 3, knife blade 14 forces the free ends 7' of contact lamellae 7 into contact with the retention spring 3. FIG. 4 is a cross-sectional view of the electrical connector 1 taken along line 3-3 in FIG. 1 before insertion of the knife blade 14.

In the assembled state, external retention spring 3 in contact segment 6 is positioned in such a manner, that it is supported by fixing elements 11 in the region of center segment 5. The spatial dimensions of external retention spring 3 are such that, in the unassembled state, contact lamellae 7 may move freely inside external retention spring 3. The free ends of the contact lamellae 7 rest on sunport elements 13 (shown in FIG. 1 in ghost lines), which are designed to be a part of the external retention spring 3.

The insertion operation of electrical connector 1 according to the present invention is as follows:

Upon insertion of a knife blade into electrical connector 1, contact lamellae 7 expand to a maximum position, at which they rest against the inside of external retention spring 3. If electrical connector 1 is slipped onto a knife blade at an angle, it is possible for individual contact lamellae 7 to give way, so that a wide opening is produced for receiving the knife blade. Because contact lamellae 7 rest against external retention spring 3, the contact lamellae must, in the event of further expansion of the contact lamellae clearance, give way in the direction of the entrance port for the knife blade prior to running up against the limiting elements of the entrance port of external retention spring 3, which stop the way of any further deformation. This is only possible when a greater force is exerted, and the result of this design is that the insertion force abruptly increases when, e.g. an unacceptably thick knife blade is used. In this manner, the person wanting to produce the electrical plug connection receives direct feedback.

Because of the flexible set-up of contact lamellae 7, knife blades standing at a slight angle may be compensated for. However, if a corresponding limit is reached, then the insertion force increases abruptly and gives proper feedback to the person.

The independence of adjacent contact lamellae 7 also results in their being adjustable to their respective optimum value of the normal contact force according to the spring characteristic of contact lamellae 7. In comparison with the related art, the disengagement or failure of a contact point 10 only occurs when the knife blade is positioned at a considerably higher angle.

What is claimed is:

1. An electrical connector in the form of a socket contact, comprising:

an inner contact part; and a spring element attached over the inner contact part, wherein the inner contact part includes:

an attachment part for receiving a bare end of an electrical line, a center segment, and a contact segment having a contact part, the contact part having at least four contact lamellae pointing away from the center segment and arranged in two pairs, each of the two pairs having two contact lamellae being opposed to each other, the contact lamellae being freely movable, each of the contact lamellae having at least one contact point for producing an electrical plug connection to a knife blade; and wherein the contact lamellae are configured to spring off freely at a beginning of an insertion of a knife blade into the contact segment, and, after further insertion of the knife blade, only free ends of the contact lamellae configured to come to maintainly rest against the spring element in direct proximity to the contact point with the knife blade maintaining contact with the contact segment and contact point during the knife blade being inserted in the socket contact.

2. The electrical connector according to claim 1, wherein the contact lamellae are formed in the shape of fingers and are only connected to each other at an end pointing to the center segment.

3. The electrical connector according to claim 1, further comprising, in a region of the free end of the contact lamellae, support elements situated at an external retention spring.

4. The electrical connector according to claim 3, wherein the external retention spring substantially completely surrounds the contact part and, thus, forms lateral limiting elements for the contact lamellae.

5. An electrical connector in the form of a socket contact, comprising:

an inner contact part; and a spring element attached over the inner contact part, wherein the inner contact part includes:

an attachment part for receiving a bare end of an electrical line, a center segment, and a contact segment having a contact part, the contact part having at least four contact lamellae pointing away from the center segment and arranged in two pairs, each of the two pairs having two contact lamella being opposed to each other, the contact lamellae being freely movable, each of the contact lamellae having at least one contact point for producing an electrical plug connection to a knife blade;

wherein the contact lamellae are spaced from the spring element along an entire length of the contact lamellae prior to insertion of a knife blade into the contact part; and wherein the contact lamellae are configured to interact with the knife blade, which maintains contact with the contact segment and contact point, so as to contact the spring element in direct proximity to the at least one contact point during the knife blade being inserted in the socket contact.

6. The electrical connector according to claim 5, wherein free ends of the contact lamellae are configured to spring off freely towards the spring element upon partial insertion of a knife blade into the contact part.

7. The electrical connector according to claim 5, wherein the free ends of the contact lamellae are configured to contact the spring upon complete insertion of the knife blade.

* * * * *